United States Patent [19]

Porter

[11] 4,049,242

[45] Sept. 20, 1977

[54] MIXER FOR PRODUCTS CONTAINED IN SEALED ENVELOPES

[75] Inventor: John H. Porter, Colchester, Vt.

[73] Assignee: Ladd Research Industries, Inc., Burlington, Vt.

[21] Appl. No.: 677,917

[22] Filed: Apr. 19, 1976

[51] Int. Cl.[2] ..... B01F 7/30

[52] U.S. Cl. ..... 259/72; 259/190

[58] Field of Search ..... 259/190, 72, 107, 108, 259/119, 121, 122, 102, 103, 105, 106, 185, 182, 7, 8, 23, 24; 222/94; 416/66, 67

[56] References Cited

U.S. PATENT DOCUMENTS

| | | | |
|---|---|---|---|
| 2,570,223 | 10/1951 | Everett | 259/108 |
| 2,795,405 | 6/1957 | Christopher | 259/122 |
| 3,332,670 | 7/1967 | Swartz | 416/67 |
| 3,543,966 | 12/1970 | Ryan | 222/94 |
| 3,722,833 | 3/1973 | Inoue | 259/72 |
| 3,771,773 | 11/1973 | Schriever | 259/185 |

*Primary Examiner*—Robert W. Jenkins
*Attorney, Agent, or Firm*—W. R. Hulbert

[57] ABSTRACT

Apparatus for mixing products within a generally flattened, flexible package having opposite side walls, comprising a support surface adapted to support one side wall of a package and mixing means adapted to contact an opposite side wall of a package on the support surface, the mixing means and support surface being mounted for rotation relatively to each other about an axis generally perpendicular to and intersecting the support surface. The mixing means includes package contacting means extending from the axis and generally parallel to the support surface and operating means for rotating the mixing means and support surface relatively to one another about the axis for mixing a product within the package during such rotation.

10 Claims, 7 Drawing Figures

FIG 1
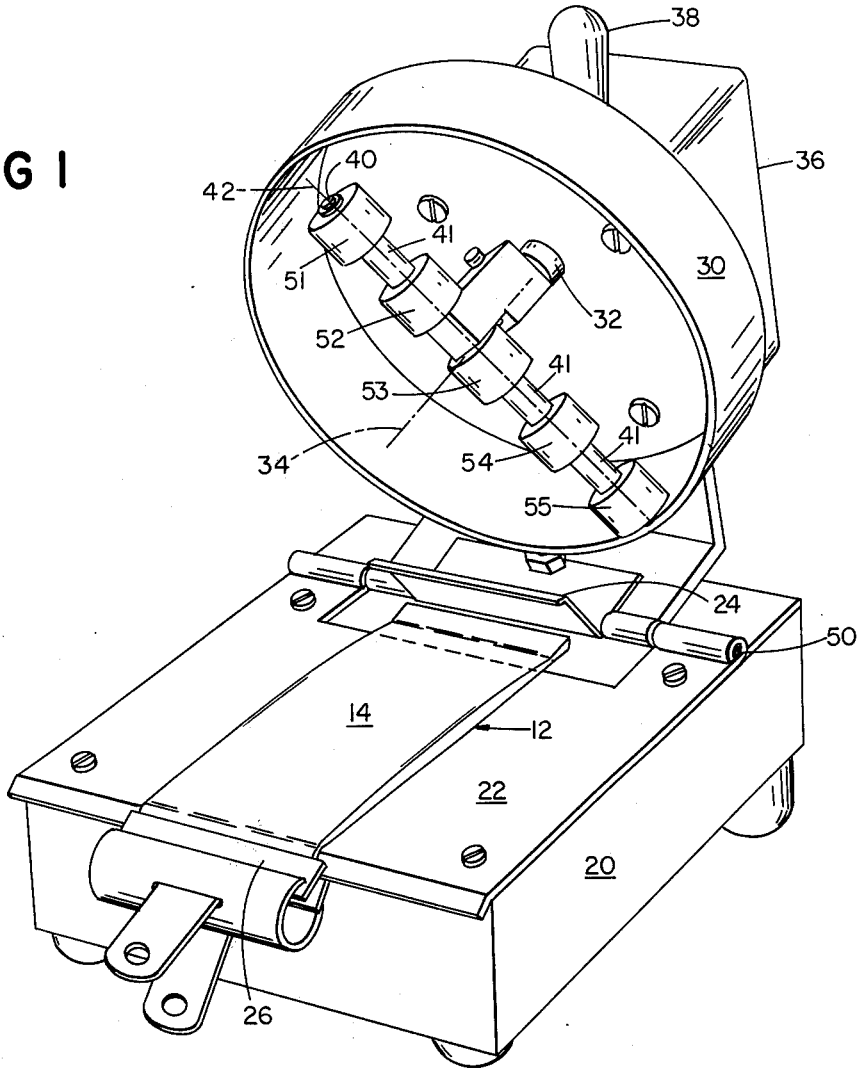
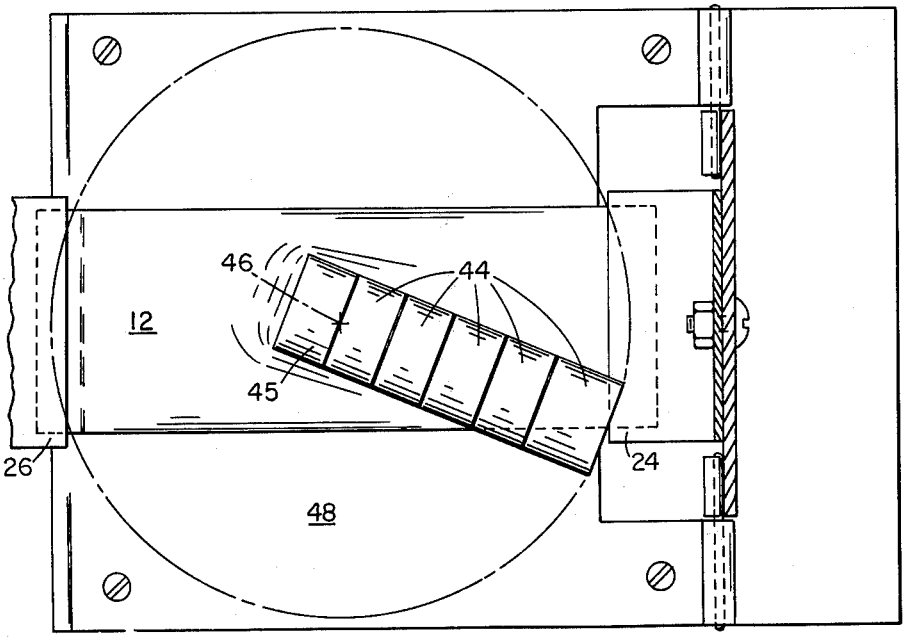
FIG 7

MIXER FOR PRODUCTS CONTAINED IN SEALED ENVELOPES

BACKGROUND OF THE INVENTION

This invention relates to mixing apparatus for mixing products contained within a generally flattened flexible package.

The mixing of products contained within a flexible package has long been realized to have a number of advantages, particularly where the products are toxic or react with the atmosphere, and various devices have been suggested to reduce the hand labor involved and to provide better mixing. For example, a simple hand roller is disclosed in U.S. Pat. No. 3,332,670, while more complicated devices are disclosed in U.S. Pat. Nos. 3,543,966 and 3,722,833. However, such devices are less effective than is desirable , in that they do not provide the desired degree of mixing within a short time period.

SUMMARY OF THE INVENTION

It is a major object of the present invention to provide apparatus for mixing products contained within a flattened flexible package which will provide better mixing in a shorter time than heretofore known devices.

It is another object of the present invention to provide such apparatus which is simple and convenient in use.

According to the invention, I provide, in apparatus for mixing products contained in a flattened, flexible package resting on a flat support by means of an orbiting roller assembly having rollers urged toward the support as they rotate to press the package thereagainst, the rollers being aligned on an axis generally parallel to the support and orbiting a second axis perpendicular to the support, the apparatus including mechanism fo rotating the roller assembly and support relatively to one another on the second axis in order to produce the rolling movement, the following improvement. The rolling surface of the centermost roller extends at least to the second axis to prevent accumulation of unmixed product thereat, the remaining rollers extend radially outwardly from said axis in at least one direction a distance sufficient to cover the area occupied by said package and the apparatus includes means for maintaining at least some of the rollers out of pressure contact with the package across at least a portion thereof during at least a portion of their orbital movement to cause mixing movement of product within the package for rapid and intimate mixing thereof and to prevent product entrapment at locations therein.

In one preferred embodiment, the aligned rollers extend radially outwardly in both directions from the second axis and the means for maintaining the at least some of the rollers out of pressure contact with the package comprise mountings which position the rollers in mutually spaced relation, with spacers therebetween, so that rollers on one side of said second axis do not track rollers on the other side of said second axis during their orbital movement; alternatively, the means for maintaining at least some of the rollers out of pressure contact with the package comprise mountings for the rollers which position them side by side substantially only on one side of the second axis, whereby products therein will flow around the aforementioned centermost roller during orbital movement of the rollers for rapid and intimate mixing thereof; or, still further alternatively, the aligned rollers are mounted side by side to extend radially outwardly in both directions from the second axis and the means for maintaining at least some thereof out of pressure contact with the package comprise cams at spaced locations on the support for periodically lifting the passing rollers out of pressure contact with the package and then again lowering them into such contact, thereby to prevent entrapment of product on opposite sides of the series of rollers which would otherwise separate the product into two unconnected pockets within the package and to promote rapid and intimate mixing thereof.

Further, in a preferred embodiment of the invention, the apparatus comprises a fixed frame member holding the support and having a movable frame member mounted thereon, the roller assembly being mounted on the movable frame member and the latter being movable between an operative position wherein the rollers bear on the package and an open position permitting insertion and removal of a package; the movable frame member is desirably hinged to the fixed member and the mechanism for relatively rotating the roller assembly and support is mounted on the movable frame member and drives the roller assembly.

For the purpose of fully describing preferred embodiments of the invention, reference is now made to the following detailed description thereof, together with the accompanying drawings.

DESCRIPTION OF THE DRAWINGS

FIG. 1 is an isometric view of one preferred embodiment of mixing apparatus of the invention with its mixing rollers in the in-operative position;

FIG. 7 is a similar view of a still further modified roller assembly.

DETAILED DESCRIPTION

Figure 2:
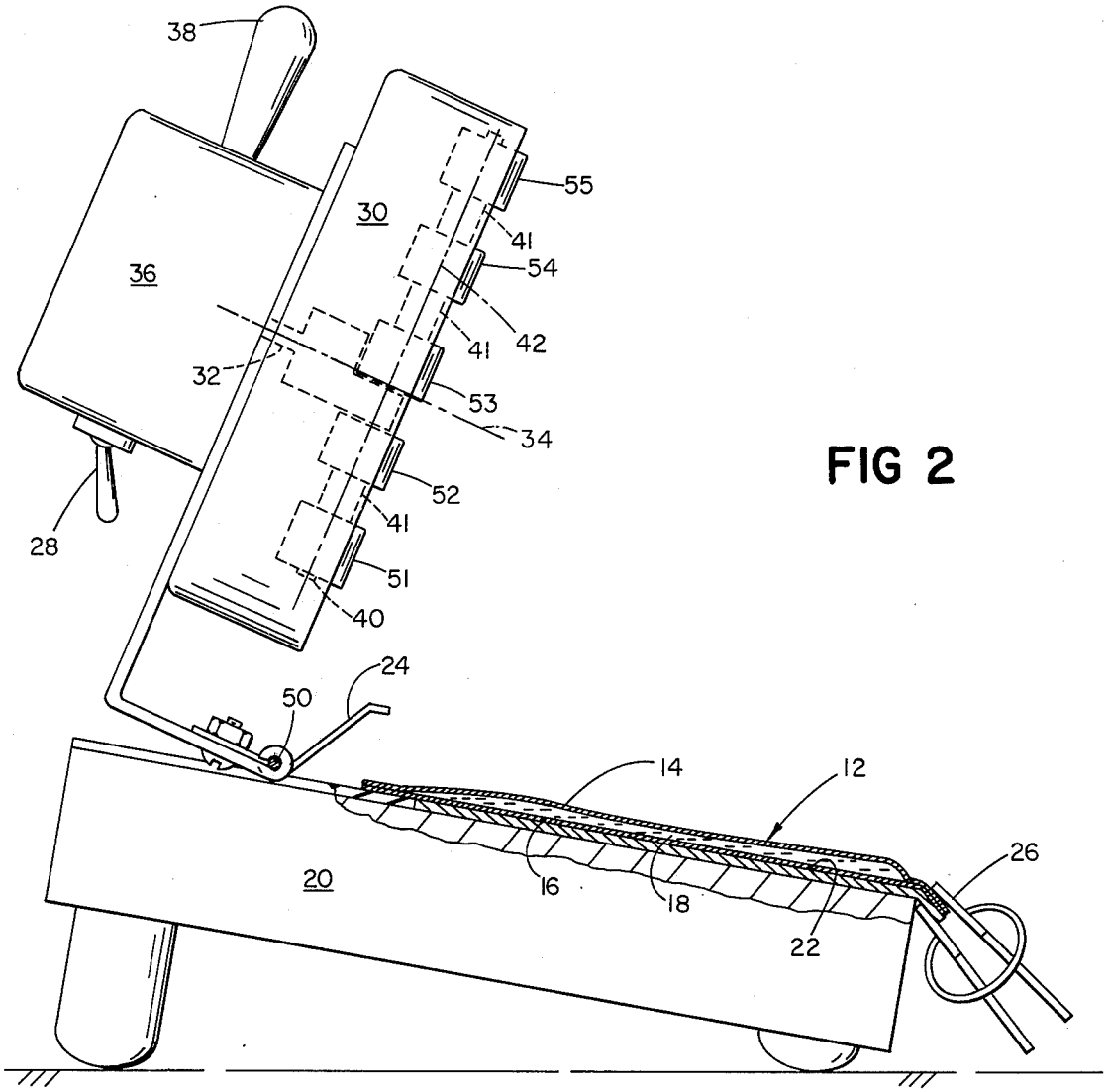
FIG. 2 is a side elevation of the apparatus as shown in FIG. 1.

Referring to the drawings, and particularly to FIGS. 1 through 5, thereof, the apparatus of the present invention for mixing products within a generally flattened, flexible package 12 having opposite side walls 14, 16 and containing therewithin a product 18 to be mixed, in general, comprises a lower, fixed frame member 20 having mounted thereon by hinge 50 an upper movable frame member 30. A handle 38 is provided for moving upper frame member 30 between its operative and inoperative positions. Upper frame member 30 carries the novel mixer device of the present invention. Lower frame member 20 has an upper support surface 22, preferable slanted at about 10 to 15 degrees by reason of the dimensions of its supporting legs, with an upper spring clamp 24 and a lower spring clamp 26, adapted to support the lower side wall 16 of a package 12.

Figure 3:
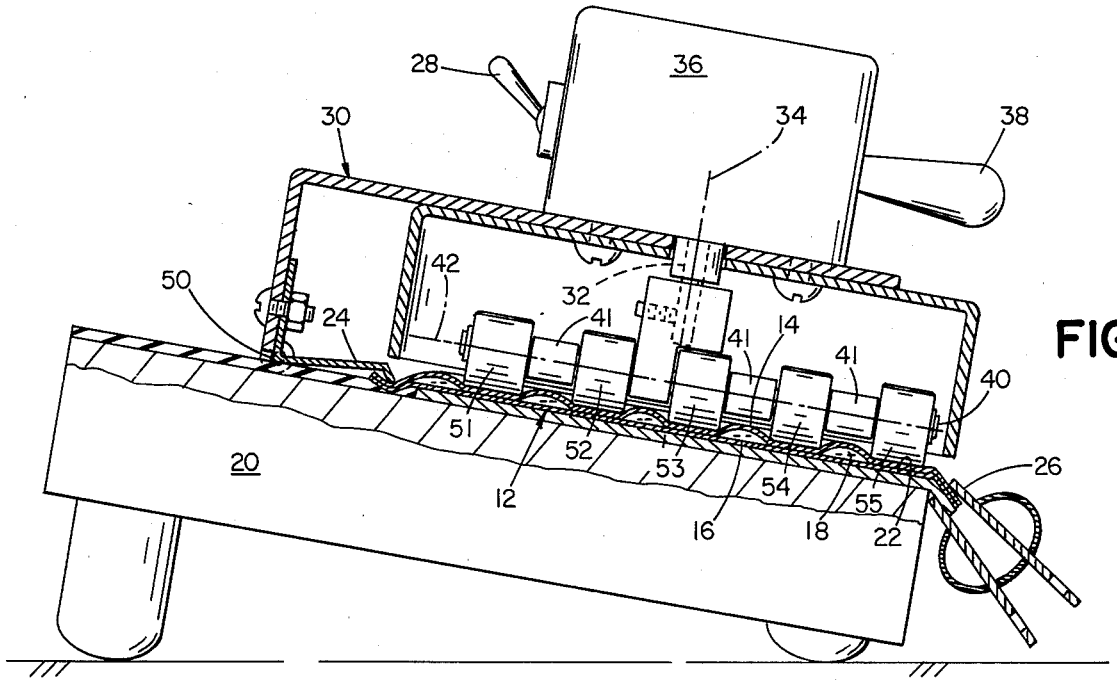
FIG. 3 is a side view similar to FIG. 2, partially in section, with its elements in operative position.
Figure 4:
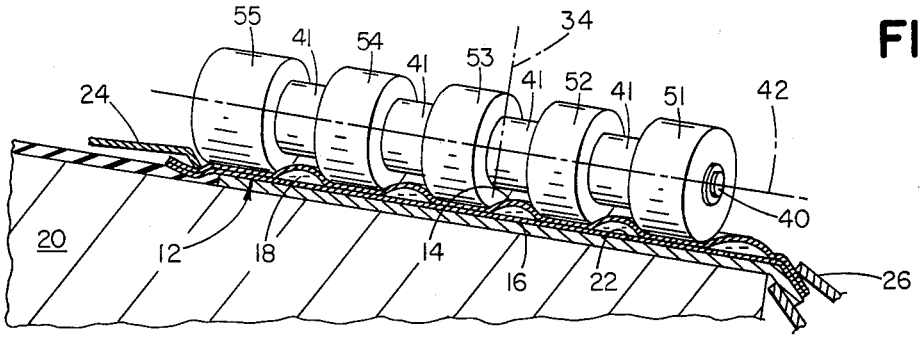
FIG. 4 is an isometric fragmentary detail view of the roller elements and the support surface of the embodiment of FIG. 1 with its elements in operative position.
Figure 5:
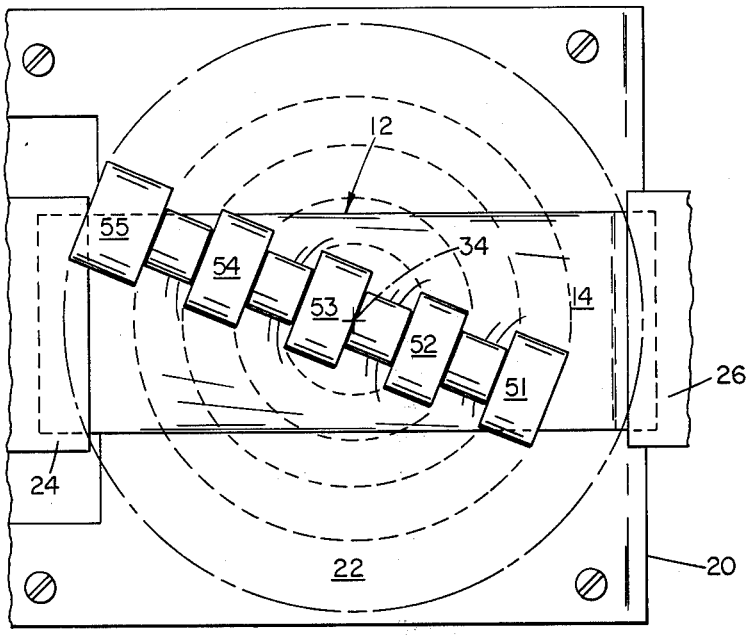
FIG. 5 is a plan view, partly broken away, of the roller elements and support surface of the same embodiment with its elements in operative position.

According to the present invention, the mixer device thereof includes a shaft 32, with its axis 34 generally perpendicular to and intersecting support surface 22 in operative position, as shown in FIGS. 3, 4 and 5, and having at its lower end a transverse shaft 40 having its axis 42 extending radially from axis 34 in opposite directions and generally parallel to support surface 22 in operative position. Shaft 40 has rotatably mounted thereon a plurality, herein shown as five, of spaced, axially aligned package-contacting, resilient roller elements 51, 52, 53, 54, 55, with spacers 41 therebetween. For reason hereinafter more fully explained, roller elements 51, 52 on one side of perpendicular shaft 32, central roller element 53 and roller elements 54, 55 on the opposite side of perpendicular shaft 32 are alternately radially spaced from the axis 34 of said shaft. Thus, the radial position occupied by a roller element on one side of axis 34 of shaft 32 is occupied by a space between roller elements on the other side of shaft 32, as indicated by the dotted circumferential lines in FIG. 5, so that rollers of one set do not track rollers of the other set. Central roller 53 should extend at least to axis 34 in order to prevent accumulation of unmixed product 18 thereat. Roller elements 51, 52, 53, 54, 55 are preferably of Neoprene but may be of any suitable resilient, relatively soft, material, of plastic or rubber, for urging the package contacting surface thereof into pressure contact with the upper side wall 14 of package 12. Shaft 32 is driven through a suitable speed reduction transmission, not shown, by motor 36 mounted on movable frame member 30 and having a switch 28. The package or envelope is usually of polyethylene but may be of vinyl or other suitable plastic compatible with the contents.

In operation, with upper movable frame member 30 in open, inoperative position, as shown in FIGS. 1 and 2, a package 12, containing product 18 to be mixed, is placed on fixed support surface 22 and clamped with lower clamp 26. Movable frame member 30 is then swung by handle 38 into its lower operative position, clamping the upper end of the package by upper spring clamp 24. The weight of frame member 30 and motor 36 urges the resilient roller elements 51, 52, 53, 54, 55 toward support surface 22 for pressure contact thereof with the upper side wall 14 of package 12. Switch 28 is then operated to start motor 36 to rotate shaft 32.

By reason of the staggered positioning of rollers 51 and 52 with respect to the other rollers 53, 54, 55 on their mutual shaft 40, the rotating assembly of package contacting roller elements is maintained out of pressure contact with the package 12 across at least a portion thereof a permit internal product flow, thereby to prevent product entrapment at locations within the package and to cause mixing movement of product 18 in directions toward, away and around perpendicular axis 34 for rapid and intimate mixing thereof.

Figure 6:
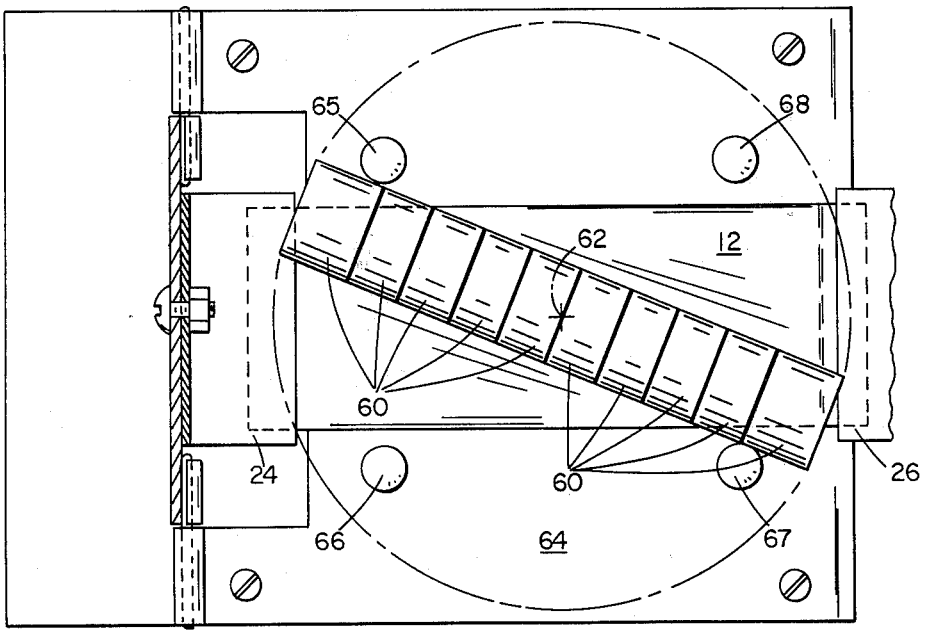
FIG. 6 is a view similar to FIG. 5 showing modified roller elements which may be substituted for those shown in the preceding views.

Other constructions of roller elements, less effective because they do not produce as great product mixing movement in directions toward and away from perpendicular axis 34 but which are nevertheless an improvement in heretofore known mixers, are illustrated in FIGS. 6 and 7. In these embodiments a portion of the effective package-contacting roller surface is maintained out of pressure contact with the package across at least a portion thereof during at least a portion of the orbital rotation of the rollers to prevent entrapment of product in two separate locations or pockets in the package during mixing and a roller surface extends at least to the perpendicular axis to prevent accumulation of unmixed product thereat.

In the embodiment of FIG. 6, there is provided a series of roller elements 60 closely adjacent one another extending on opposite sides of perpendicular axis 62. To prevent entrapment of product on opposite sides of the series of roller elements 60, which would divide product 18 in two unconnected pockets and so prevent mixing thereof, support surface 64 is provided with two pairs of upstanding cam surfaces 65, 67 and 66, 68 which engage roller elements 60 and thereby raise the roller assembly out of effective pressure contact with package 12 at 90° spaced angular positions as the rollers orbit axis 62.

The FIG. 7 embodiment is also provided with a series of roller elements 44 closely adjacent one another and orbiting the perpendicular shaft 46. These rollers, however, extend substantially on one side only of shaft 46, so that product 18 in package 12 on support surface 48 is not entrapped in separate pockets, but can flow around the central end roller 45 of the assembly of roller elements.

It is also contemplated that mixing apparatus as claimed herein, with the mixing means and support surface rotating relatively to one another, may include constructions wherein the mixing means is stationary and the support surface is rotated, in addition to the constructions herein disclosed.

What is claimed is:

1. In apparatus for mixing products contained in a flattened flexible package resting on a flat support by means of a roller assembly having a plurality of rollers urged toward the support as they rotate to press the package thereagainst, the rollers being aligned on an axis generally parallel to the support and orbiting a second axis generally perpendicular to the support, the apparatus having mechanism for rotating the roller assembly and support relatively to one another on said second axis to produce the rolling movement, the improvement wherein the rolling surface of a centermost roller extends at least to said second axis to prevent accumulation of unmixed product thereat, the remaining rollers extend radially outwardly from said axis in at least one direction to cover the area occupied by said package, and including means for maintaining at least some of said rollers out of pressure contact with package across at least a portion thereof during at least a portion of their orbital movement to cause mixing movement of product within the package for rapid and intimate mixing thereof and to prevent product entrapment at locations therein.

2. Apparatus as claimed in claim 1 wherein said aligned rollers extend radially outwardly in both directions from said second axis and said means for maintaining at least some of said rollers out of pressure contact with the package comprise mountings which position said rollers in mutually spaced relation with spacers therebetween so that the rollers on one side of said axis do not track rollers on the other side of said axis during their orbital movement.

3. Apparatus as claimed in claim 1 wherein said means for maintaining at least some of said rollers out of pressure contact with the package comprise mountings for said rollers which position them side by side substantially only on one side of said second axis whereby products therein will flow around said centermost roller during orbital movement of said rollers.

4. Apparatus as claimed in claim 1 wherein said aligned rollers extend side by side radially outwardly in both directions from said second axis and said means for maintaining at least some thereof out of pressure contact with the package comprise cams at spaced locations on said support for periodically lifting the passing rollers out of pressure contact with the package and then lowering them into such contact thereby to prevent separation of product on opposite sides of the series of rollers and entrapment thereof in two unconnected pockets within the package.

5. Apparatus as claimed in claim 1 including a fixed frame member holding said support and having a movable frame member mounted thereon said roller assembly being mounted on said movable frame member and the latter being movable between an operative position wherein said rollers bear on said package and an open position permitting insertion and removal of a package.

6. Apparatus as claimed in claim 5 wherein said movable frame member is hinged to said fixed member.

7. Apparatus as claimed in claim 6 wherein said mechanism for relatively rotating said roller assembly and said support is mounted on said movable frame member and drives said roller assembly.

8. Apparatus as claimed in claim 7 wherein said aligned rollers extend radially outwardly in both directions from said second axis and said means for maintaining at least some of said rollers out of pressure contact with the package comprise mountings which position said rollers in mutually spaced relation with spacers therebetween so that the rollers on one side of said axis do not track rollers on the other side of said axis during their orbital movement.

9. Apparatus as claimed in claim 7 wherein said means for maintaining at least some of said rollers out of pressure contact with the package comprise mountings for said rollers which position them side by side substantially only on one side of said second axis whereby products will be forced to flow around said centermost roller during orbital movement of said rollers.

10. Apparatus as claimed in claim 7 wherein said aligned rollers extend side by side radially outwardly in both directions from said second axis and said means for maintaining at least some thereof out of pressure contact with the package comprise cams at spaced locations on said support for periodically lifting the passing rollers out of pressure contact with the package and then lowering them into such contact thereby to prevent separation of product on opposite sides of the series of rollers and entrapment thereof in two unconnected pockets within the package.

* * * * *